US008646273B2

(12) United States Patent
Schuster et al.

(10) Patent No.: US 8,646,273 B2
(45) Date of Patent: Feb. 11, 2014

(54) THERMODYNAMIC MACHINE AND METHOD FOR THE OPERATION THEREOF

(75) Inventors: Andreas Schuster, Tussenhausen (DE); Andreas Sichert, Laufen (DE); Richard Aumann, Leutkirch (DE)

(73) Assignee: Orcan Energy GmbH, Munich (DE)

( * ) Notice: Subject to any disclaimer, the term of this patent is extended or adjusted under 35 U.S.C. 154(b) by 81 days.

(21) Appl. No.: 13/508,422

(22) PCT Filed: Oct. 30, 2010

(86) PCT No.: PCT/EP2010/006640

§ 371 (c)(1),
(2), (4) Date: May 7, 2012

(87) PCT Pub. No.: WO2011/057724

PCT Pub. Date: May 19, 2011

(65) Prior Publication Data

US 2012/0227404 A1 Sep. 13, 2012

(30) Foreign Application Priority Data

Nov. 14, 2009 (DE) ..... 10 2009 053 390

(51) Int. Cl.
*F01K 25/08* (2006.01)
*F01K 25/00* (2006.01)
*F01K 13/00* (2006.01)

(52) U.S. Cl.
USPC ..... 60/651; 60/645; 60/671

(58) Field of Classification Search
USPC ..... 60/645–681
See application file for complete search history.

(56) References Cited

U.S. PATENT DOCUMENTS

| | | | | |
|---|---|---|---|---|
| 4,291,232 | A | 9/1981 | Cardone et al. | |
| 4,517,804 | A * | 5/1985 | Ura et al. | 60/657 |
| 4,738,111 | A | 4/1988 | Edwards | |
| 4,766,730 | A * | 8/1988 | Amano et al. | 60/641.5 |
| 5,660,042 | A * | 8/1997 | Bronicki et al. | 60/641.5 |
| 2004/0255587 | A1 | 12/2004 | Radcliff et al. | |

(Continued)

FOREIGN PATENT DOCUMENTS

| | | | |
|---|---|---|---|
| DE | 7225314 | U | 11/1973 |
| DE | 3641122 | A1 | 7/1987 |

(Continued)

OTHER PUBLICATIONS

International Search Report for PCT/EP2010/006640, Mailing Date: Aug. 18, 2011 (9 pages).

(Continued)

*Primary Examiner* — Thomas Denion
*Assistant Examiner* — Brian Inacay
(74) *Attorney, Agent, or Firm* — Mendelsohn, Drucker & Dunleavy, P.C.; Steve Mendelsohn

(57) ABSTRACT

The invention relates to a thermodynamic machine having a circulation system in which a working fluid, in particular a low-boiling working fluid, circulates alternately in a gaseous and a liquid phase, a heat exchanger, an expansion machine, a condenser, and a fluid pump. The invention also relates to a method for operating the thermodynamic machine. According to certain embodiments of the invention, in the flow line of the fluid pump, a partial pressure increasing the system pressure is applied to the liquid working fluid by adding a non-condensing auxiliary gas. Compact ORC machines can be implemented, preventing cavitation in the liquid working fluid.

14 Claims, 2 Drawing Sheets

(56) References Cited

U.S. PATENT DOCUMENTS

| | | | | |
|---|---|---|---|---|
| 2006/0196187 | A1* | 9/2006 | Zimron et al. | 60/651 |
| 2008/0223044 | A1* | 9/2008 | Dearman | 60/671 |
| 2009/0320478 | A1* | 12/2009 | Head | 60/657 |
| 2010/0192573 | A1* | 8/2010 | Hamilton et al. | 60/645 |

FOREIGN PATENT DOCUMENTS

| | | | |
|---|---|---|---|
| DE | 198 53 206 | C1 | 3/2000 |
| DE | 102006013190 | A1 | 10/2006 |
| DE | 10 2008 013545 | A1 | 9/2009 |
| JP | 58144613 | | 8/1983 |
| JP | 2004353517 | | 12/2004 |

OTHER PUBLICATIONS

German Office Action: Mailed Feb. 10, 2010 for corresponding German Application No. 10 2009 053 390.7.

Decision Of Grant; Mailed Jan. 13, 2011 for corresponding Germany Application No. 10 2009 053 390.7.

International Preliminary Report On Patentability and Written Opinion; Mailed Jun. 12, 2012 for corresponding PCT Application No. PCT/EP2010/006640.

English Translation of Notice of Reason for Rejection; Mailed May 21, 2013 for corresponding JP Application No. 2012-538221.

* cited by examiner

THERMODYNAMIC MACHINE AND METHOD FOR THE OPERATION THEREOF

FIELD OF THE INVENTION

The invention relates to a thermodynamic machine with a cyclic system, in which a particularly low-boiling working fluid circulates alternately in a gas phase and a liquid phase. In this case, the machine comprises a heat exchanger, an expansion machine, a condenser and a liquid pump. The invention additionally relates to a method for the operation of such a thermodynamic machine, wherein in a cycle the working fluid is heated, expanded, condensed and delivered by means of pumps of the liquid working fluid.

BACKGROUND OF THE INVENTION

Particularly a machine which operates in accordance with the thermodynamic Rankine cyclic process is understood by such a thermodynamic machine. The Rankine cyclic process in this case is characterized by pumping the liquid operating medium, by evaporating the operating medium at high pressure, by expanding the gaseous working fluid—performing mechanical work—and by condensing the gaseous working fluid at low pressure. Modern conventional steam power plants, for example, operate in accordance with the Rankine cyclic process. In fossil-heated steam power plants steam is typically produced with temperatures of over 500° C. at a pressure of over 200 bar. Condensing of the expanded steam takes place at about 25° C. and a pressure of about 30 mbar.

A thermodynamic machine operating in accordance with the Rankine cyclic process and also a method for the operation thereof is known from WO 2005/021936 A2, for example. Water serves as working fluid in this case.

If heat sources, which for the heat sink have only a relatively small temperature difference, are to be used for evaporating the working fluid, then the efficiency which can be achieved with the working fluid in the form of water is no longer sufficient for an economical mode of operation. Such heat sources, however, can be exploited with the aid of so-called ORC machines, in which instead of the working fluid in the form of water a low-boiling, especially organic fluid is used. From the point of view that such a fluid boils at lower pressures compared with water or has a higher vapor pressure in comparison to water, is understood by the term "low-boiling". An ORC machine operates in accordance with the so-called organic Rankine cyclic process (ORC), i.e. basically with an especially organic, low-boiling working fluid which differs from water. As working fluids for an ORC machine, for example hydrocarbons, aromatic hydrocarbons, fluorinated hydrocarbons, carbon compounds—especially alkanes, fluoro ethers, fluoroethane—or even synthesized silicone oils are known.

By means of ORC machines or ORC plants, the heat sources available in geothermal or solar power plants, for example, can be economically used for power generation. Also, with an ORC machine it has been possible up to now for non-utilized waste heat of an internal combustion engine from exhaust air, cooling circuit, exhaust gas, etc., to be used for performing work or for power generation.

If the vapor pressure of a liquid which is associated with a respective temperature is fallen short of, this liquid evaporates. The falling short of the vapor pressure can take place in static or in moving liquids.

For example, in the case of a flowing liquid the vapor pressure can be locally fallen short of on account of a sharp deflection or acceleration of the flow so that a local evaporation takes place. The locally resulting vapor bubbles condense again at points of higher pressure and break down. The overall process is referred to as cavitation.

In a thermodynamic machine of the type referred to in the introduction, a cavitation which occurs in the liquid phase of the working fluid constitutes a not insignificant problem. On account of the small size of the vapor bubbles, the condensing of these takes place very quickly in fact. As a result of a sudden implosion of the vapor bubbles, a microjet is possibly formed in the process. If this is directed onto a surrounding wall, then pressure peaks of up to 10 000 bar can be locally achieved. In addition, as a result of the high pressures local temperatures of way above 1000° C. can be achieved, which can lead to melting processes in the wall material. Damage effects as a result of cavitations can occur within hours.

In a pump, the occurrence of cavitation, moreover, undesirably reduces the throughput of fluid. Since the vapor bubbles in their density as a rule differ considerably from the liquid, the deliverable mass flow is reduced even in the case of a low mass proportion of the working fluid as vapor at a given volumetric flow. In the event of a heavy build-up of vapor, the mass flow possibly even breaks down. If the working machine is used as a pump in an ORC plant, for example, then the entire cyclic process may possibly come to a standstill. As a result of the deficient pump output, a backing-up of the liquid working fluid in the condenser occurs, as a result of which its action is significantly reduced. As a result of this, the dissipation of heat comes to a halt. The overall system cannot easily be left in this state. A waiting period must be observed until the working fluid cools down by cooling of its own accord. In addition, the throughflow in the evaporator breaks down so that no heat can be dissipated any longer either. The working fluid which is used can then possibly be damaged as a result of exceeding its stability limit.

For a machine operating in accordance with the Rankine cyclic process, the problem of cavitation occurring is described in EP 1 624 269 A2, for example. There, a cavitation in the working fluid in the form of water inside the condenser and also inside the subsequent pump is to be prevented by a specific pressure and temperature control being provided at the condenser.

Corresponding pressure and temperature sensors are included for this. In particular, the water level in the condenser is maintained at a predetermined level. This is assisted by means of a drain valve which discharges water or non-condensing gases to the outside.

Also, the significance of a constant water level in the condenser for a machine operating in accordance with the Rankine cyclic process is described in U.S. Pat. No. 7,131,290 B2. Disclosed in particular is the effect of a variable water level upon the cooling surfaces in the condenser which come into effect. If non-condensing gas, such as air, penetrates into the cyclic system of the working fluid on account of the negative pressure conditions which prevail in the condenser, then this collects especially in the condenser. In order to prevent a loss of cooling capacity resulting therefrom, U.S. Pat. No. 7,131,290 B2 proposes a corresponding separation and drain device.

A complex fluid machine, which operates in accordance with the Clausius-Rankine cyclic process, is known from DE 10 2006 013 190 A1. The fluid machine has a pump for applying a pressure and for pumping out a liquid-phase working fluid, and an expansion device, connected in series to the pump, for creating a driving force by means of expansion of the working fluid which is heated in order to become a gas-phase working fluid. It is provided in this case to transfer the heat of the working fluid on an outlet side of the expansion device to the working fluid on an outlet side of the fluid pump.

A transportable drive unit for the conversion of heat, which is designed as a thermodynamic machine of the type referred to in the introduction and operates in accordance with the Rankine cyclic process, is known from DE 36 41 122 A1.

A steam power plant is known from DE 7 225 314 U, wherein an organic working medium is used in the Rankine cyclic process.

Also, a thermodynamic machine of the type referred to in the introduction is known from U.S. Pat. No. 4,291,232. In this case, a gas/liquid solution, especially an ammonia/water solution, circulates as working fluid.

By dissolution of the gas in the liquid, the pressure of the gas and liquid is lowered. By separating the gas under a temperature increase, the pressure is increased.

SUMMARY OF THE INVENTION

It is an object of the invention to develop a thermodynamic machine of the type referred to in the introduction to the effect that the occurrence of cavitation in the liquid or in the liquid working fluid is avoided as far as possible. It is furthermore an object of the invention to disclose a corresponding method for the operation of such a thermodynamic machine, wherein cavitation in the liquid is avoided as far as possible.

With regard to the machine, the set object is achieved according to certain embodiments of the invention by means of the feature combination according to claim 1. According to this, for a thermodynamic machine of the type referred to in the introduction it is provided that a partial pressure, which increases the system pressure, is applied to the liquid working fluid in the head of the liquid pump by the addition of a non-condensing auxiliary gas.

The invention is based in this case upon the knowledge that particularly in the conception of an ORC machine, the possibility of an occurrence of cavitation in the liquid phase is underestimated. It therefore happens that in the overall conception a head height specified for a pump, for example, is not observed. Such a head height, as a result of the fluid column at the suction connector, brings about a necessary pressure increase there. On account of the upstream condenser, the fluid, without observing the head height, is particularly applied to the pump at the saturation vapor pressure or condensation vapor pressure if it is assumed therefrom that no subcooling takes place. When the pump is engaged, without observing the head height, the saturation vapor pressure can then be fallen short of as a result of the ensuing suction power. Cavitation occurs.

The head height for a pump is typically given by the so-called NPSH value. In this case, the necessary minimum feed height above the saturation vapor pressure is understood by the NPSH value (Net Positive Suction Head value). In other words, the necessary NPSH value expresses the suction power of the pump. The NPSH value is specified in meters. For a pump which is suitable here, it is typically several meters. If for a given pump the NPSH value is therefore not observed in the head, then not insignificant cavitation problems occur during operation. An undesirable development of vapor bubbles occurs.

In this respect, even in the conception of a small and compact ORC machine, the pump has to be disadvantageously arranged at a lowered level with regard to the level of the plant, which leads to an undesirable increase of installation space.

Alternatives to avoiding cavitation in the liquid phase of the working fluid, such as a subcooling of the working fluid for lowering the vapor pressure, are expensive on account of the additional cost. An additional surface area requirement also results. Moreover, more energy for heating the subcooled working fluid has to be applied. Equally, the use of a booster pump for creating an additional pressure at the suction connector is not economical. Apart from that, additional installation space is also required as a result of an additional pump.

Surprisingly, the invention now recognizes that the problem of the creation of cavitations in a thermodynamic machine can be solved by the use of a non-condensing gas. Whereas previously in machines operating in accordance with the Rankine cyclic process non-condensing gas located in the cycle was expensively removed as being undesirable because it lowered the efficiency, the invention now provides a deliberate introduction thereof.

The invention particularly recognizes that in the case of a non-condensing gas being in the cycle its partial pressure in the gas phase is added to the condensation pressure. The system pressure resulting therefrom, which is increased in the desired manner, is applied to the liquid working fluid especially in the head of the liquid pump. The disadvantages which are associated with the addition of a non-condensing gas into the cycle, such as particularly an increase of the back-pressure for the expansion machine, is offset by the advantages of an avoidance of cavitation in the case of a low-boiling working fluid. In the case of a low-boiling working fluid, it condenses at higher pressures compared with water. It can typically be condensed above atmospheric pressure at room temperature. The partial pressure which is necessarily created by means of the auxiliary gas has a lesser—and in the sense of the overall concept—negligible effect upon the overall efficiency in this respect.

In detail, in certain embodiments, the invention allows the added substance quantity of the auxiliary gas to be selected so that the head height for the pump can be correspondingly reduced in the sense of the available installation space. At the same time, consideration can be given in this case to the fact that the backpressure which is impedimental for the expansion machine remains at an altogether acceptable level.

The invention, in certain embodiments, offers the distinct advantage in this respect that a compact thermodynamic machine for the utilization of low-temperature heat sources can be conceived. The installation space in this case is no longer necessarily predetermined by the necessary head height of the pump. Since basically the non-condensing auxiliary gas can be introduced on a one-off basis when filling the system, possibly even no constructional additional measures at all are required. In this respect, in certain embodiments, the invention offers an exceptionally inexpensive possibility for a further compacting of a thermodynamic machine. The invention, in certain embodiments, is extremely suitable in this respect for the conception of small mobile machines which are used for example on motor vehicles for the utilization of the engine heat, cooling medium heat or exhaust gas heat.

In an advantageous development, the partial pressure which results by the addition of the auxiliary gas is sufficiently high so that the saturation vapor pressure is not fallen short of in the head during operation of the liquid pump. As is explained in the following text, this, with certain simplifying assumptions (no additional subcooling of the liquid), is the case, for example, when the resulting partial pressure corresponds at least to the NPSH value of the liquid pump. A head height of the pump can possibly even be completely dispensed with. Under actual conditions, the volume of the added auxiliary gas must be proportioned so that the resulting partial pressure exceeds the suction pressure or the converted NPSH value.

The invention is not necessarily restricted to a thermodynamic machine which operates in accordance with the Rankine cyclic process. Also covered, for example, can be a machine which comprises no evaporation of the working fluid upstream of the expansion machine but in which a flash evaporation of the working fluid is carried out in the expansion machine as a result of a continuously increasing working space. In particular, continuous phase changes can be undertaken.

In the sense of an ORC machine, mixtures of different working media can also be used as working fluid in order to thus achieve an ideal mode of operation of the machine which is adapted to the given conditions.

With reference to FIG. 2, to the sub-figure on the left, in a thermodynamic machine of the prior art the saturation vapor pressure $p_s$ of the working fluid is established in the condenser corresponding to the given temperature. If the pump for drawing off the liquid phase of the working fluid is engaged, then a suction pressure according to the given NPSH value is created at the suction connector. The saturation vapor pressure $p_s$ is reduced by this suction pressure $p_{NPSH}$. As a consequence, an inlet pressure $p_E$, which is lower than the saturation vapor pressure $p_s$ results at the pump. Consequently, the forming of vapor bubbles occurs, so cavitation occurs.

By means of an added non-condensing auxiliary gas (right-hand sub-figure of FIG. 2), a system pressure, which is the sum of the saturation vapor pressure $p_s$ and the partial pressure $p_{part}$ of the auxiliary gas, results at the pump. After engaging the pump, this system pressure is again reduced by the suction pressure $p_{NPSH}$ which is predetermined by the NPSH value. If the partial pressure $p_{part}$ of this non-condensing gas, which results on account of the introduced auxiliary gas, is greater than or at least equal to the suction pressure $p_{NPSH}$ at the suction connector of the pump, then the inlet pressure $p_E$ is now, however, at least equal to or greater than the saturation vapor pressure $p_s$. Cavitation is therefore prevented.

For a desired pressure difference $\Delta p$ between the system pressure and the saturation vapor pressure, which is to be applied by means of the auxiliary gas, this is advantageously at least $p_{NPSH}$ the necessary substance quantity $x_i$ of the auxiliary gas being calculated according to $$x_i = \frac{\Delta p}{\Delta p + p_s}$$

For an actual system, the substance quantity $x_i$ of the auxiliary gas is then proportioned so that even with unfavorable conditions, that is to say at reduced condensation temperatures and therefore reduced saturation vapor pressures, sufficient auxiliary gas is available. Also to be taken into consideration is the fact that some of the auxiliary gas goes into solution and therefore is no longer available for creating a pressure difference. When proportioning the added substance quantity of the auxiliary gas, different operating phases of the machine (partial load, full load) can also be taken into consideration.

In a preferred development of the machine, according to the aforesaid embodiments, the constructional height can be correspondingly reduced by the actual head height of the liquid pump being reduced compared with a necessary head height which takes into consideration the NPSH value and, if applicable, a subcooling of the liquid working fluid. As a result of an additional subcooling of the liquid, the necessary head height is reduced on account of the lowered vapor pressure. The possible, further reduction of the actual head height is provided as a result of the partial pressure of the introduced auxiliary gas. In this case, for keeping certain reserves, a small head height can also be maintained despite corresponding feeding in of the auxiliary gas. A reduction of the head height is compensated in this respect by means of a corresponding substance quantity of the auxiliary gas.

The point of introduction for the auxiliary gas can be provided basically at any point of the cyclic system of the machine. The point of introduction can be designed in this case for an introduction on a one-off basis or for a repeated introduction of the auxiliary gas. In a preferred development, a point of introduction for the auxiliary gas is provided between the expansion machine and the liquid pump. In this way, the auxiliary gas is available directly at the required point in the cycle. The auxiliary gas is introduced into the liquid phase on the cold side of the cyclic process. In particular, the auxiliary gas can also be easily removed there since it can be collected in the condenser. To this end, for example the machine can be "cold-run", as a result of which the auxiliary gas flows slowly into the condenser. For adding the auxiliary gas, a compressor, for example, can be used. Alternatively, a pressurized cylinder can be connected. Adding the auxiliary gas on the hot side of the cyclic process is associated with additional cost.

The non-condensing auxiliary gas is a gas of the type which does not condense under the conditions which prevail or are given in the cycle of the thermodynamic machine. Inert noble gases or nitrogen, for example, are suitable as such an auxiliary gas. Suitable organic gases are also a possibility.

The non-condensing auxiliary gas is moved to a certain extent by the working fluid in the cycle of the thermodynamic machine. In machines operating in accordance with the Rankine cyclic process with the working fluid in the form of water, so-called shell-and-tube heat exchangers are customarily provided for the condenser. In this case, a cooling liquid flows through the interior of the tubes.

The gaseous working fluid flows along the tubes on the outside, condenses on their surface, and drips off as condensate or liquid phase.

In such a condenser, depending upon its orientation, the non-condensing auxiliary gas possibly accumulates, however, with disadvantageous effect. In this case, the auxiliary gas remains as an insulating layer around the tubes, as a result of which the efficiency of the condenser is reduced. The non-condensing auxiliary gas can only be broken down by means of an extraction against the flow direction of the condensate or by means of diffusion.

In order to avoid this disadvantage when a non-condensing auxiliary gas is being added, the condenser is advantageously designed for an entrainment of the auxiliary gas in the flow direction of the condensate or of the liquid working fluid. Such a condenser is designed for example as an air condenser or by means of plate-type heat exchange elements. In the case of an air condenser, the gaseous working fluid flows through the interior of tubes which on the outside are exposed to circumflow by air, for example, but also by another cooling medium. In this case, the auxiliary gas is pushed through the tubes in the flow direction at least partially by following gaseous working fluid. This also applies to condensers which are formed by means of plate-type heat exchange elements. Also in this case, the gaseous working fluid flows through the interspaces of the plate-type heat exchange elements and some of the auxiliary gas is taken from the condenser as well. The undesirable effect of the forming of an insulating layer which is produced for a shell-and-tube heat exchanger is lessened as a result of this.

In addition, a sensor for detecting the auxiliary gas concentration is preferably arranged in the header tank. By means of such a sensor, which is arranged in the gas space above the collected liquid of the working fluid, the substance quantity of the auxiliary gas existing in the cyclic system, for example, can be measured and a warning signal can be issued when a predetermined limit value is fallen short of or exceeded. Corresponding to the warning signal, a specific substance quantity of the auxiliary gas can then be added or extracted.

As previously described, the disclosed thermodynamic machine is particularly suitable for a mobile plant in a motor vehicle, wherein the heat exchanger is thermically connected to a waste heat source of the vehicle. For example, the coolant, another operating medium, such as oil, the engine block itself, or the exhaust gas, constitutes such a waste heat source.

The expansion machine which is connected to a corresponding generator for power generation is preferably designed as a positive displacement machine. Such a positive displacement machine is, for example, a screw-type or piston expansion machine, or a scroll expansion machine. A vane-cell machine can also be used.

The object which is directed towards a method is achieved according to the invention by means of the feature combination according to claim 9. According to this, for a method for the operation of a thermodynamic machine it is provided that a partial pressure, which increases the system pressure, is applied to the liquid working fluid in a pump head by the addition of a non-condensing auxiliary gas.

Further preferred developments can be gathered from the dependent claims which are directed towards a method.

In this case, the advantages which are referred to for the machine can be logically correspondingly carried over.

BRIEF DESCRIPTION OF THE DRAWINGS

Exemplary embodiments of the invention are explained in more detail with reference to a drawing. In this case, in the drawing.

DETAILED DESCRIPTION

Figure 1:
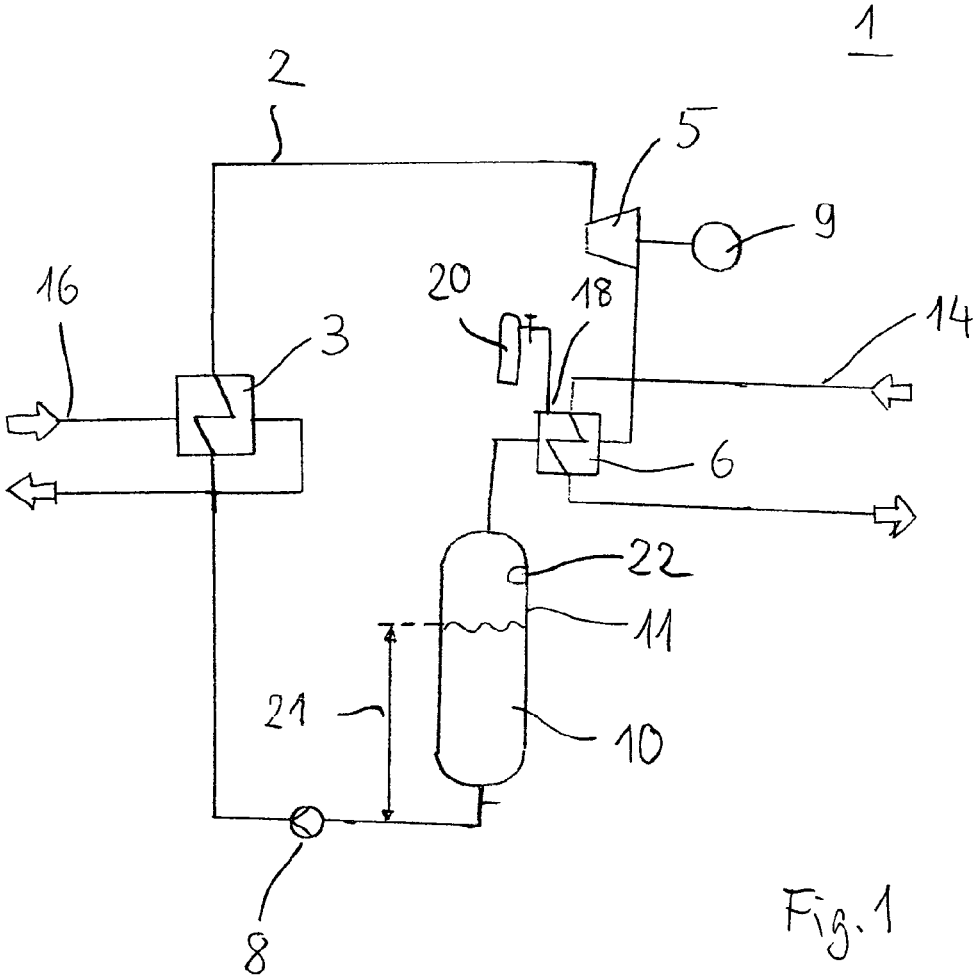
FIG. 1 schematically shows an ORC machine with a partial pressure of an auxiliary gas applied in the pump head.
Figure 2:
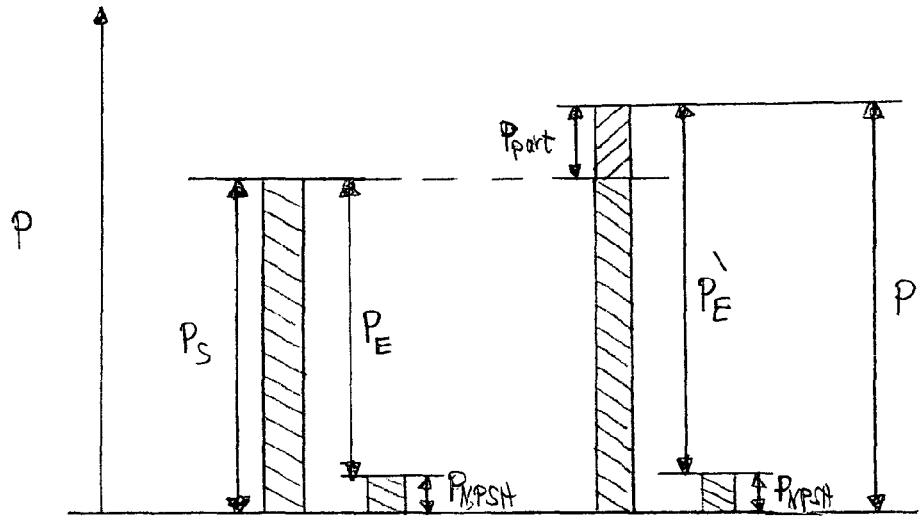
FIG. 2 shows a schematic view of different pressure conditions.

Schematically shown in FIG. 1 is an ORC machine 1, as is suitable particularly as a mobile plant for the utilization of waste heat of internal combustion engines. The ORC machine 1 comprises in this case—in a cyclic system 2—an evaporator as a heat exchanger 3, an expansion machine 5, a condenser 6 and a liquid pump 8. The depicted ORC machine 1 operates in accordance with the Rankine cyclic process, wherein work is performed on the expansion machine 5 for driving a generator 9. The generator 9 is designed particularly for feeding the generated power to the motor vehicle's own electric system, or is connected thereto. A hydrocarbon, which has a significantly higher vapor pressure compared with water, is used as working fluid 10. The working fluid 10 is located in a closed cycle.

The liquid working fluid 10 which is delivered via the liquid pump 8 is evaporated in the evaporator 3 at a high pressure. In the expansion machine 5, which is designed as a positive displacement machine, the gaseous working fluid 10 is expanded, performing work.

The expanded gaseous working fluid 10 is condensed in the condenser 6 at low pressure. The saturation vapor pressure which is established in the condenser 6 is about 1.2 bar. The condensate or the liquid working fluid 10 is collected in a header tank 11 before it is delivered again for evaporation by means of the pump 8.

A waste heat discharge 14 is provided for cooling the condenser 6. For example, this can be circulating air of a motor vehicle, wherein the condensation heat of the working fluid is fed to the circulating air for heating the interior of the vehicle, for example. The condenser 6 is designed as an air condenser, in which the working fluid 10 to be cooled flows along the interior of tubes which are exposed to a circumflow.

For evaporating the working fluid 10 which is delivered by the pump 8, heat is fed to the evaporator 3 via a waste heat feed 16. To this end, heat from the exhaust gas of the vehicle's engine is fed to the evaporator 3 via a suitable exchange of heat. Alternatively, heat can be supplied from the cooling circuit of the internal combustion engine. The waste heat of the internal combustion engine and of the generated exhaust gas can also be fed collectively to the evaporator 3 via a corresponding third medium.

Between the expansion machine 5 and the liquid pump 8, provision is made on the condenser 6 for a point of introduction 18 for introducing a non-condensing auxiliary gas 20 into the cycle of the ORC machine 1. Via a corresponding valve, a specific substance quantity $x_i$ of the auxiliary gas 20 can be introduced on a one-off basis or repeatedly into the cycle of the ORC machine. The substance quantity $x_i$ is proportioned in this case so that in the head of the pump 8 the partial pressure of the auxiliary gas 20 and the saturation vapor pressure of the working fluid 10 (resulting from the condensation in the condenser 6) add up to a system pressure in such a way that after engaging the pump the saturation vapor pressure of the working fluid is not fallen short of. As a result of this, a falling short of the saturation vapor pressure at deflections of the flowing working fluid in the liquid phase is also prevented. The quantity substance $x_i$ is particularly proportioned in such a way that the resulting partial pressure of the auxiliary gas is greater than the suction pressure corresponding to the NPSH value of the pump. In this respect, cavitation is prevented in the head and especially at the suction connector of the liquid pump 8. Since the saturation vapor pressure of the working fluid 10 is not fallen short of during operation, no vapor bubbles are formed there.

The head height 21 (drawn in schematically here) is clearly lowered by only some tens of centimeters in relation to the NPSH value of the liquid pump 8. A sensor 22 for measuring the concentration of the auxiliary gas 20 is arranged in the header tank 11.

The invention claimed is:

1. A thermodynamic machine with a cyclic system, in which an organic Rankine working fluid circulates alternately in a gaseous phase and a liquid phase, with a heat exchanger, with an expansion machine, with a condenser, and with a liquid pump, wherein a partial pressure, which increases the system pressure, is applied to the liquid phase of the working fluid in the head of the liquid pump by the addition of a non-condensing auxiliary gas.

2. The thermodynamic machine as claimed in claim 1, wherein the partial pressure which results by the addition of the auxiliary gas is sufficiently high so that the pressure at the head of the liquid pump does not drop below the saturation vapor pressure of the working fluid during operation of the liquid pump.

3. The thermodynamic machine as claimed in claim 1, wherein the head height of the liquid pump lower than a minimum necessary head height based on the net positive suction head (NPSH) value and a subcooling of the liquid working fluid.

4. The thermodynamic machine as claimed in claim 1, wherein a point of introduction for the auxiliary gas is provided between the expansion machine and the liquid pump.

5. The thermodynamic machine as claimed in claim 1, wherein the condenser is designed for entrainment of the auxiliary gas in the flow direction of the working fluid, as an air condenser or by means of plate-type heat exchange elements.

6. The thermodynamic machine as claimed in claim 1, wherein the expansion machine is a positive displacement machine.

7. The thermodynamic machine as claimed in claim 1, wherein a sensor for detecting the auxiliary gas concentration is arranged in a header tank of the liquid working fluid.

8. The thermodynamic machine as claimed in claim 1, wherein the thermodynamic machine is a mobile plant for a motor vehicle, and wherein the heat exchanger is thermically connected to a waste heat source of the motor vehicle.

9. A method for the operation of a thermodynamic machine, wherein, in a cyclic system, an organic Rankine working fluid circulates alternately in a gas phase and a liquid phase, and wherein the working fluid is heated, expanded, condensed, and delivered by pumping of the liquid, wherein a partial pressure, which increases the system pressure, is applied to the liquid phase of the working fluid in the head of the liquid pump by the addition of a non-condensing auxiliary gas.

10. The method as claimed in claim 9, wherein the partial pressure which results by the addition of the auxiliary gas is sufficiently high so that the pressure at the head of the liquid pump does not drop below the saturation vapor pressure of the working fluid during operation of the liquid pump.

11. The method as claimed in claim 9, wherein the auxiliary gas is added to the expanded, gaseous working fluid.

12. The method as claimed in claim 9, wherein the auxiliary gas is further transported, principally in the flow direction, during the condensing of the working fluid.

13. The method as claimed in claim 9, wherein the working fluid is expanded in a positive displacement machine.

14. The method as claimed in claim 9, wherein waste heat of a motor vehicle is used for heating and/or evaporating the working fluid.

* * * * *